United States Patent [19]

Probost

[11] 4,272,332

[45] Jun. 9, 1981

[54] METHOD FOR MAKING TABLE KNIVES HAVING A SILVER-PLATED HANDLE

[75] Inventor: Werner Probost, Deggingen, Fed. Rep. of Germany

[73] Assignee: Wurttembergische Metallwarenfabrik, Geislingen an der Steige, Fed. Rep. of Germany

[21] Appl. No.: 55,311

[22] Filed: Jul. 6, 1979

[30] Foreign Application Priority Data

Jul. 6, 1978 [DE] Fed. Rep. of Germany ..... 2829776

[51] Int. Cl.[3] ..... C25D 5/02; B25G 3/00; B21K 11/02

[52] U.S. Cl. ..... 204/15; 30/342; 76/104 R

[58] Field of Search ..... 76/104 R, 105, 106; 204/15, 18.1, DIG. 7; 30/340, 342, 344

[56] References Cited

U.S. PATENT DOCUMENTS

| | | | |
|---|---|---|---|
| 432,991 | 7/1890 | Eggleston | 30/342 |
| 931,471 | 8/1909 | Peck | 30/342 |
| 1,633,783 | 6/1927 | Giles | 30/342 |

*Primary Examiner*—T. M. Tufariello
*Attorney, Agent, or Firm*—Finnegan, Henderson, Farabow, Garrett & Dunner

[57] ABSTRACT

A method for making table knives is disclosed wherein the blade including its foot portion and shank is made electrically insulated from the handle and subsequently the blade foot portion is ground flush prior to the handle being silver-plated.

2 Claims, 6 Drawing Figures

METHOD FOR MAKING TABLE KNIVES HAVING A SILVER-PLATED HANDLE

Figure 1:
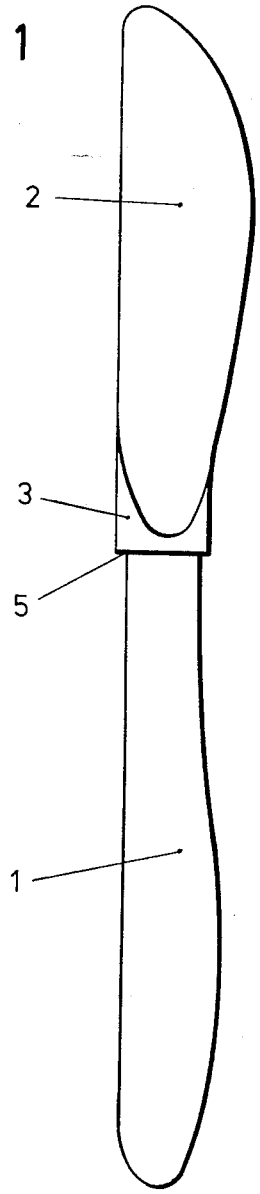

This invention relates to a method for making table knives having a handle and inserted therein a blade including an enlarged foot portion, wherein the handle is electroplated with silver, and the blade foot portion is ground flush with the handle.

In a known method of this type, the handle is silver-plated prior to the blade being connected thereto. Subsequently the shank of the blade is cemented or lead-soldered into the hollow handle. The blade foot portion is then frequently somewhat oversize with respect to the handle. This requires the foot portion to be ground flush with the handle in a subsequent operation. This grinding operation on the one hand may not result in a shoulder remaining between the silver-plated handle and the blade foot portion, while on the other hand the electroplated silver layer must not be damaged. This grinding operation is performed manually by means of a grinding disk or a grinding belt and requires highly skilled operators, i.e. highly-paid personnel having undergone several months of training.

The inventor has already tried to affix the blade to the handle prior to the silver-plating thereof and to grind the foot portion flush with the handle also prior to the silver-plating step. In the following silver-plating step it cannot then be avoided, however, that the blade is also silver-plated adjacent its foot portion. The hard silver-plating usually applied to high-Quality knives requires a nickel base plating which results in it being no longer possible to remove the nickel and silver layers on the blade by mechanical means.

It is an object of the invention to provide a method of the type described in the introduction permitting to obtain in an economical manner the proper dimensions at the joint between the blade and the handle without the danger of damage to the silver layer.

In order to attain this object the invention provides that the blade with its foot portion and shank is electrically insulated from the not yet plated handle prior to or during insertion thereinto, and that thereafter the blade foot portion is ground flush and the handle thereupon silver-plated.

The method according to the invention provides the advantage that the blade foot portion may be ground flush with the not yet silver-plated handle. A slight grinding of the handle's surface may therefore be tolerated, so that the grinding operation does not require particularly skilled operators. It may even be possible to automatize the grinding operation. For the final plating step the electric contact is established at the handle, with the insulation preventing any silver, or nickel, respectively, to be deposited on the blade. With the silver-plating and polishing step the production process is finished, no further treatment being required. The method thus permits to make knives of highest quality in a very simple manner.

Figure 2:
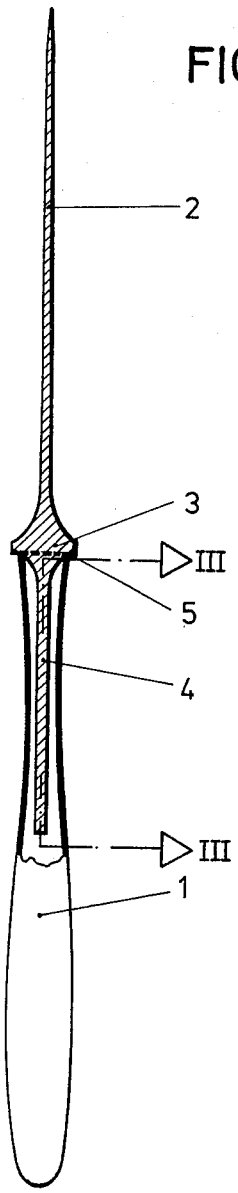
Figure 3:
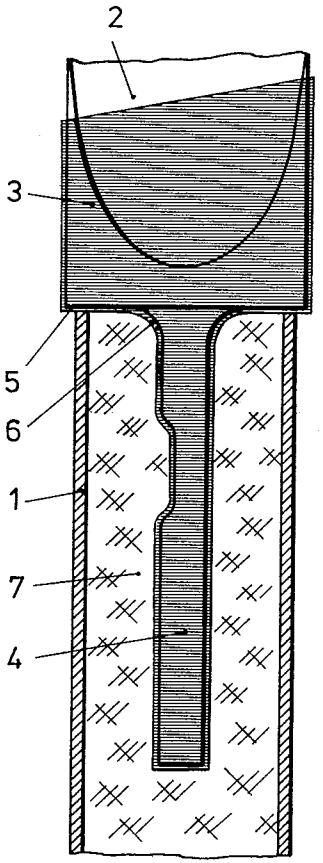
Figure 4:
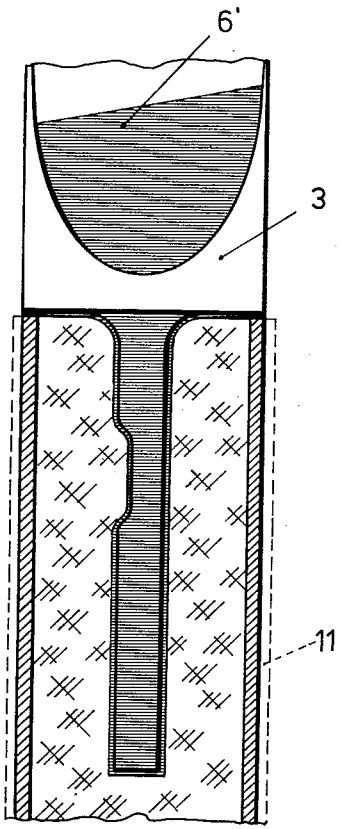
Figure 5:
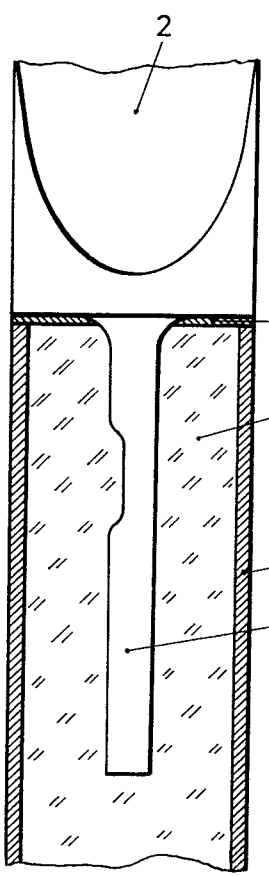
Figure 6:
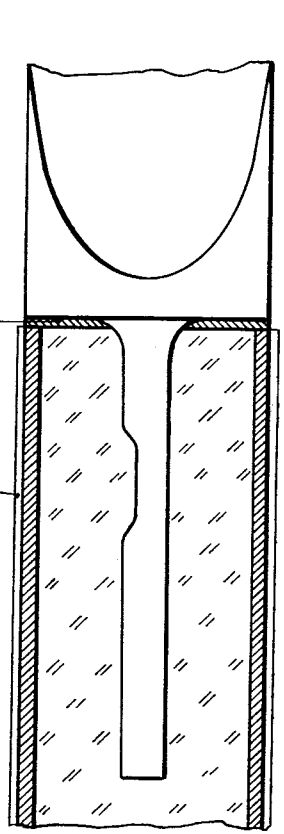

The invention shall now be explained in detail with reference to two exemplary embodiments shown in the drawings, in which:

FIG. 1 shows a side view of a table knife prior to flush-grinding of the blade foot portion, FIG. 2 shows a partially sectioned front view of a table knife prior to flush-grinding of the blade foot portion, FIG. 3 shows a sectional view according to the line III—III in FIG. 2 of a first embodiment of a knife made according to the invention after the process step of coating with a dipping varnish, FIG. 4 shows a sectional view as in FIG. 3 after flush-grinding, FIG. 5 shows a sectional view corresponding to FIG. 3 of a second embodiment of a knife made in accordance with the invention, including an insulating disk and a bond formed of a non-conductive ceramic cement composition or a synthetic resin composition, after the process step of flush-grinding, and FIG. 6 shows a sectional view as in FIG. 5 after the silver-plating step.

Shown in FIGS. 1 and 2 is a knife consisting of a hollow handle 1 and a blade 2 having a foot portion 3 and a shank 4 inserted in handle 1. The blade foot portion 3 is somewhat oversize with respect to handle 1 as shown at 5.

In FIG. 3 it can be seen that blade 2 is coated with an electrically insulating dipping varnish 6 at its shank 4 and foot portion 3. The coating is applied by dipping and has a thickness of about 0.1 to 0.4 mm. The shank 4 is embedded in a ceramic composition 7 within hollow handle 1.

The next process step is shown in FIG. 4. The blade foot portion 3, which in FIG. 3 is still somewhat oversize as at 5, has been ground flush with handle 1, with a small degree of grinding of the wall of handle 1 being acceptable. The handle may now be electroplated with a silver layer shown in phantom lines in FIG. 4 as at 11. The portion 6' of the dipping varnish 6 adhering to the blade proper can be peeled off without difficulty.

In a second embodiment of the production method shown in FIGS. 5 and 6, an insulating disk 9 make of PTFE is inserted between blade 2 and handle 1 adjacent foot portion 3.

FIG. 5 shows a knife made in this manner after the process step of flush-grinding. In this embodiment an electrically insulating synthetic resin composition 10 incorporating a filler material is employed for embedding shank 4 within handle 1.

FIG. 6 shows a sectional view of the second embodiment after the silver-plating step. The silver layer 11 ends exactly at the insulating disk 9.

In a not shown further embodiment of the method according to the invention, an insulating disk is inserted between the blade and the handle adjacent the blade foot portion in addition to the dipping varnish covering the foot portion and shank of the blade. This results in the advantage that a cement composition employed for fixing the shank within the handle need not be electrically insulating.

The method according to the invention is not restricted to employ in the making of table knives. It is for instance generally applicable to the production of correspondingly designed cutlery.

I claim:

1. A method for making table knives and the like having a handle consisting mainly of metal, and a blade inserted therein and having a blade foot portion, wherein the handle is electrolytically silver-plated and the blade foot portion is ground flush with the handle, characterized in that prior to or during insertion into the not yet silver-plated handle, the blade including its foot portion and shank is electrically insulated from the handle by coating with an electrically insulating dipping varnish or by inserting an insulating disk between the handle and blade and embedding same within the handle in a ceramic cement composition or synthetic resin composition having non-conductive properties after drying, and in that subsequently the blade foot portion is ground flush prior to the handle being silver-plated.

2. A method of making a table knife or the like comprising the steps of assembling a hollow metal handle and a metal blade having a blade foot and a shank by inserting said shank into said handle and positioning said foot adjacent said handle, providing electrical insulating means between said blade and said handle to electrically insulate the blade from the handle, grinding said blade foot flush with said handle, and thereafter electrolytically silver-plating said handle.

* * * * *